US005675851A

United States Patent [19]

Feathers

[11] Patent Number: 5,675,851

[45] Date of Patent: Oct. 14, 1997

[54] X-RAY TABLE EXTENSION FOR HEAD AND UPPER BODY SUPPORT

[76] Inventor: John A. Feathers, 8751 Broadway #3205, Houston, Tex. 77061

[21] Appl. No.: 728,292

[22] Filed: Oct. 8, 1996

[51] Int. Cl.[6] ..... A61G 13/12; A47C 20/02

[52] U.S. Cl. ..... 5/632; 5/601; 5/622; 5/638; 108/69

[58] Field of Search ..... 5/632, 630, 622, 5/601, 621, 638, 623, 624, 922, 640, 643, 646, 648; 108/69; 378/177, 208, 209

[56] References Cited

U.S. PATENT DOCUMENTS

| | | | |
|---|---|---|---|
| 2,753,233 | 7/1956 | Rock | 5/622 |
| 2,872,259 | 2/1959 | Thorpe | 5/621 |
| 4,076,230 | 2/1978 | Pike | 5/622 |
| 4,669,106 | 5/1987 | Ammerman | 5/601 |
| 4,688,780 | 8/1987 | Hanz | 5/622 |
| 4,989,849 | 2/1991 | Zupancic | 5/622 |
| 5,233,713 | 8/1993 | Murphy et al. | 5/601 |
| 5,347,668 | 9/1994 | Manning | 5/622 |

*Primary Examiner*—Alexander Grosz
*Attorney, Agent, or Firm*—Gunn & Associates, P.C.

[57] ABSTRACT

The present disclosure is directed to an extension device to be affixed to table in a radiology laboratory to hold a patient thereon. It is formed of sheet material and is transparent to x-rays. At the upper end, there is a head portion having a width and length to support a cushion to thereby enable a patient to rest on the cushion. The cushion is preferably circular with a central opening so that the patient can rest face down as required and the sheet member includes an opening therebelow. The trunk of the patient is support on the main portion which has a width sufficient to hold the patient thereon. Left and right clamps releasably secure the device on a table. Cushions are attached with strips of Velcro. Lengthwise runners on the lower side attach the device in a locked position on an x-ray table.

13 Claims, 1 Drawing Sheet

FIG. 1
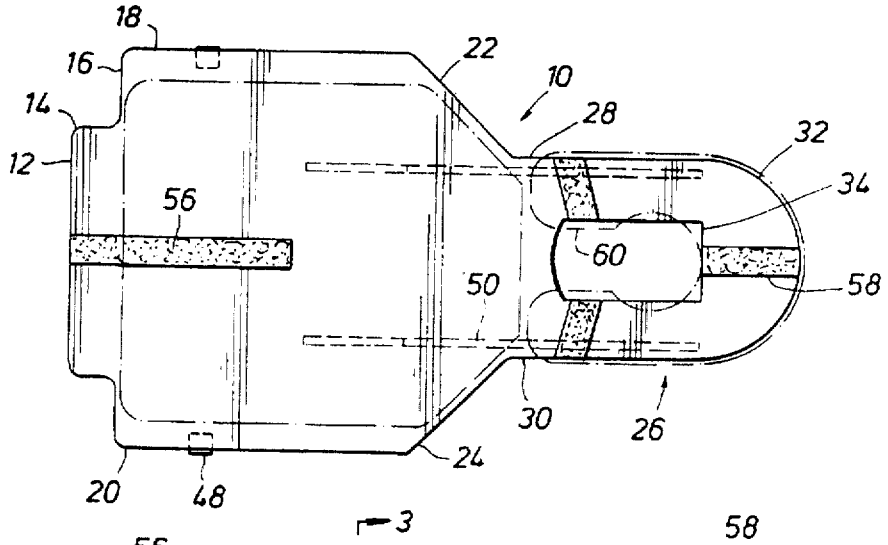
FIG. 2
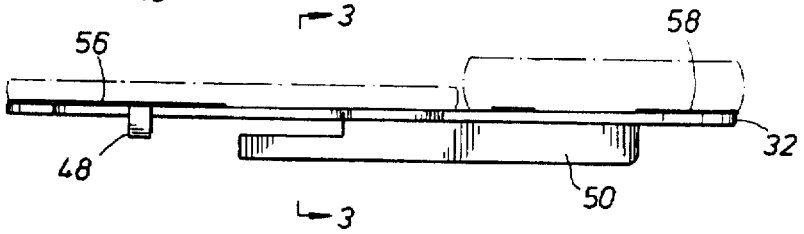
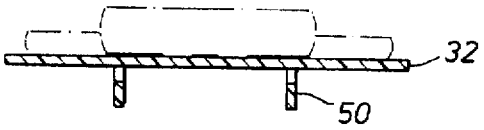
FIG. 3
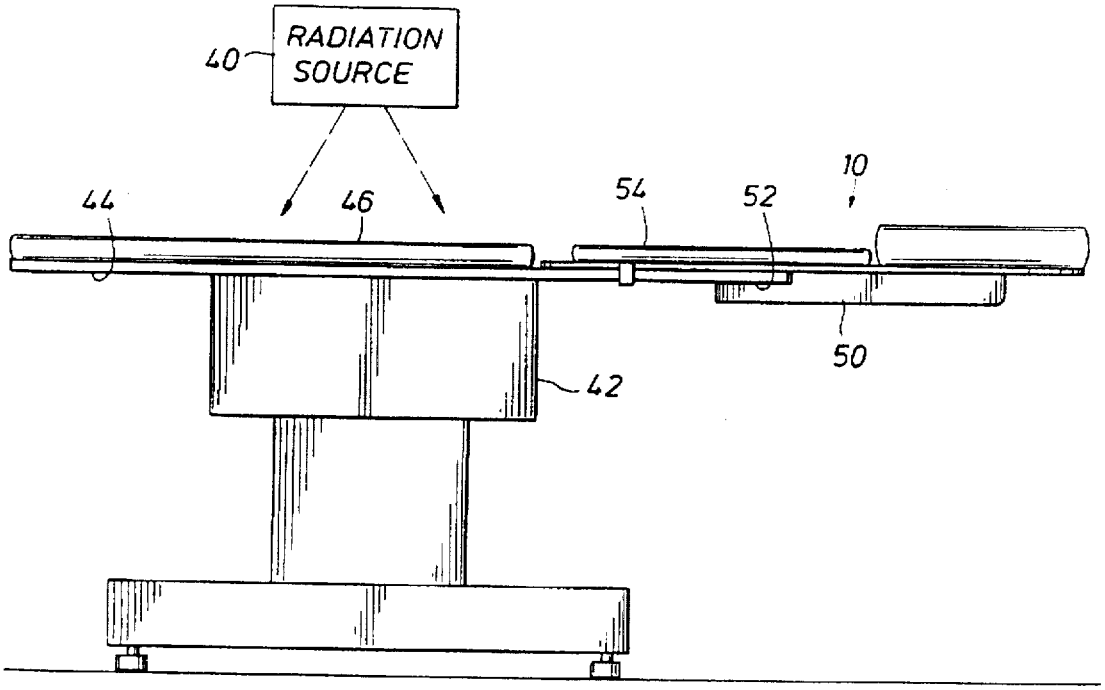
FIG. 4

X-RAY TABLE EXTENSION FOR HEAD AND UPPER BODY SUPPORT

BACKGROUND OF THE DISCLOSURE

The present disclosure is directed to a table extension for use with patients to provide x-rays. It is typically used in an x-ray studio, normally, a radiology lab. The studio is equipped with an overhead x-ray generating system typically deployed on some type of overhead hanger permitting movement in two dimensions, even sometimes three dimensions, so that the x-ray generating source is brought close to a patient. The patient is typically rested on a patient table in the center of the room for easy x-ray examination.

Medical diagnosis sometimes requires x-rays to determine the precise nature and location of injuries, internal ailments, etc. In some instances, the patient can stand upright to provide a chest x-ray while in other instances, x-rays of the arms and legs are done by extending the limb over the film in a film holder or film pack. In some instances, however, it is especially necessary for the patient to be prone on a table so that appropriate posture is obtained with the patient extending transverse to the centerline axis of the x-ray source. Normally, the x-ray generating tube points downwardly. A table which supports the patient horizontally at an elevated position above the floor and below the x-ray source positions the patient appropriately. The present disclosure is directed to a table extension mechanism which has certain advantages. In one aspect, the patient is able to stretch out in a prone position, either face up or down, thereby enabling the patient to be appropriately illuminated by the x-ray source. In this fashion, the patient is positioned in the most desirable position from the point of view of the physician requesting the radiology report. The procedure thus involves positioning the patient on top of the table equipped with the extension of the present disclosure. The x-ray film is mounted in a flat pack or tray which is located under the patient. The present apparatus is especially helpful in obtaining that kind of x-ray exposure of the film. Optimum comfort of the patient is obtained.

The present apparatus is especially useful in that the device is transparent to x-rays. Moreover, it is relatively lightweight in view of the fact that it has to be moved in or out, shifted, sometimes removed completely, and sometimes equipped with cushions or pillows. Patient comfort is an important factor. It may take five or ten minutes to arrange or position the trunk of the patient body at the right location and then take several different images. Especially when working with older patients, personal comfort becomes more important. The x-ray procedure requires that the patient be still, perfectly still, which is sometimes difficult for those who are older. Muscles may shake, or other types of patient agitation may disrupt and upset the situation. Moreover, the situation often requires that the patient be assisted to mount the table and to position their head and shoulders in a prone position. For comfort, the present disclosure, therefore, incorporates a mechanism and means enabling the patient to rest their head, again facing up or down, in a fashion that head and face comfort are obtained. As the patient reclines, they are easily supported on the present apparatus for a long period of time so that patient comfort can, therefore, be obtained. In another aspect of the present disclosure, the patient requires protection against sliding over the edge of the examination table. Through the use of the present invention, the weight of the patient is supported on a horizontal surface so that sliding over the edge is not readily possible. To protect the patient, the apparatus of the present disclosure is equipped with safety clamps to assure proper fastening to a support table. Moreover, it incorporates a mechanism enabling pads or cushions to be positioned to encircle either the face or the back of the head to further assist patient comfort. It also enables movement of the film tray under the patient and movement of the patient with respect to the table so that appropriate positioning of the x-ray system, film and patient can be obtained. Repositioning is easily achieved through the use of the present disclosure. The finished product is relatively lightweight and, therefore, can be easily handled by medical personnel with great dispatch so that the device can be installed, used, repositioned and then removed. Subsequent installation is again achieved in an easy way.

SUMMARY OF THE PRESENT INVENTION

This disclosure is directed to a large planar extension member formed of clear, translucent or transparent plastic material and is constructed with sufficient thickness that it is able to hold up the cantilevered weight of a heavy patient. The patient is supported on the top face of the board. It includes a narrow portion which approximately matches the width of the patient at the shoulders tapering to a smaller width under the head. Being slightly wider than the head, this enables a central portion to be cut away. When the patient reclines on the device and turns their face downwardly, this enables easy breathing for the patient without discomfort. A pad having the shape of a U-shaped collar is supported on the table extension and serves as a head rest or face rest. On the lower side, there are safety clamps protruding along marginal edges for fastening the device. In addition to that, a pair of ribs are constructed with overhanging notches to lock against the table. This secures the device of the present disclosure in a fixed position to support a patient placed on the table.

BRIEF DESCRIPTION OF THE DRAWINGS

So that the manner in which the above recited features, advantages and objects of the present invention are obtained and can be understood in detail, more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope. The invention may admit to other equally effective embodiments.

FIG. 1 is a plan view of the support board of the present disclosure setting forth profile and shape and further showing the location of Velcro strips for fastening a pillow at the head of the support board:

FIG. 2 is a side view of the same board as shown in FIG. 1 showing a head rest in dotted line and also showing a cushion placed thereon for comfort of a patient;

FIG. 3 is a sectional view a long the line 3—3 of FIG. 2 of the drawings showing details of construction of two parallel reinforcing ribs on the bottom side which assist in attachment to a patient table; and FIG. 4 is a view of the support board of the present disclosure installed on an x-ray table and illustrates the enhancement provided by the present support board.

DETAILED DESCRIPTION OF THE PREFERRED EMBODIMENT

Attention is now directed to FIG. 1 of the present disclosure which will be discussed initially and which shows the extending support board 10 of the present disclosure. The support 10 comprises a board of planar construction having a central protruding tab 12 at the left end, the tab 12 being formed with curved or rounded corners 14. The edge 16 defines the full width of the structure which is formed with a pair of parallel edges 18 and 20. The edges extend parallel and forward to a pair of tapering edges 22 and 24. The edges 22 and 24 taper down to a narrow neck portion 26 which is adapted to support the head and neck of a patient. The neck portion 26 is defined by two parallel edges 28 and 30. They terminate at a curving radius 32 which is an arc of a circle. The neck portion is formed with a rectangular notch 34 along the centerline axis of the device.

Viewed from the side in FIG. 2, it will be observed that the support 10 of the present disclosure is a planar sheet of material which is preferably a clear or at least translucent plastic material. Not only can one see through it, but it also is constructed so that it has substantial strength and yet is transparent to x-rays.

Going now to FIG. 4 of the drawings, a radiation source 40 is indicated in an overhead position and is located above a pedestal 42 which supports a table 44. As appropriate, a cushion 46 is placed on the table for comfort. One important aspect of this view is to show how the table 44 has a specified length or span. Even so, the table 44 is not always able to provide a full and adequate support or base under the patient in the prone position to obtain all the necessary x-ray exposures at different angles and inclinations with respect to the patient. As will be understood, a radiologist will typically specify the relative position of the patient and also the position of the radiation source with respect to that patient. The position of the radiation source with respect to the table 44 is therefore adjusted, typically by moving the radiation source 40 which is suspended over the table 44 and which is mounted in a movable fashion with two and usually three degrees of freedom. This measure of freedom is highly desirable.

The freedom mentioned above is enhanced by the use of the support 10 of the present disclosure. It is used in the following manner. It is normally placed above the table 44. It is moved left and right so that it slides into a desired position. For safety, downwardly extending locks 48 located along the marginal edges are engaged. They are channel-shaped so that they lock or guide the support 10 to a specified location. Moreover, at that location, they hold the transparent support in a cantilevered position but it is held in such a way that it will not topple because of the offset center of mass. As viewed in FIG. 4, the apparatus 10 is installed by sliding to the left. It is moved to the left until it is stopped. This motion is stopped by the cooperation of a pair of parallel braces 50 which are located on the bottom side. They are notched at 52 to define an overhanging relationship that locks around the table 44. This permits movement to the left but it is limited at the time the notches 52 are properly engaged. Once engaged, the support 10 is then held in a proper position.

FIG. 4 shows the installation of a pad 54 at the central part of the invention 10. For convenience, it is held in a releasable connection by means of a Velcro strip 56 better shown in FIG. 1 of the drawings. In a similar fashion, FIG. 1 of the drawings also shows multiple Velcro strips 58 which are used for fastening on the support a head or face pad shown in dotted line at 60 in FIG. 1 of the drawings. It is shaped as a horseshoe. The central opening lines up with the rectangular opening 34. These two openings together provide comfort to the head or face. The patient is able to rest in that position for extended intervals during a radiology session. Often, several frames of film have to be exposed to get the right contrast and perspective necessary for the radiologist.

Continuing with some details of importance, the present apparatus is made of stock having a thickness of about ½". The stock is well able to hold the weight of the patient on it. For ease of handling, the edges are typically slightly beveled and the corners are rounded as previously noted at 14. The width of the apparatus is appropriate for patient support. The edges 18 and 20 are typically about 16 but preferably about 18 or 20" apart. They preferably match the width of the table 44 so that the safety clamps 48 are lined up and clamp against the table. The head portion 26 is more narrow, typically in the range of about 9 to 12".

The bottom located braces 50 provide strength against bending. In addition, they also provide limits on the mounting of the device. This helps obtain registration without taking measurements. In addition to that, it helps by locking the entire structure so that the device can be easily installed and then removed while a patient is being positioned and then repositioned with respect to the table 44. For instance, it may be necessary to obtain several views without use of the device 10; thereafter, the device 10 is mounted on the table 44, and that is accomplished in one easy motion by the personnel handling the radiology session.

Considering even further the present apparatus, it is well able to be mounted on and then removed from the table 44. When removed, it can be readily placed in a place of safekeeping. It can be used with or without the cushions previously noted and they can be attached or detached using the many Velcro strips 56 and 58.

While the foregoing is directed to the preferred embodiment, the scope is determined by the claims which follow:

I claim:

1. A demountable table extension for use with a patient supporting table in obtaining x-rays wherein the table extension comprises an elongate planar sheet formed of a material transparent to x-rays and having an end located head portion adapted to be placed under the head of a patient resting thereon wherein said head portion incorporates an opening therein aligning with the face of a patient thereon and facing downwardly, said support apparatus further incorporating a body portion to thereby support the upper portions of the body of the patient thereon and said body portion is aligned with said head portion and has a width sufficient to support the body of the patient thereon, and including means for releasably attaching to a patient table in operative proximity of an x-ray radiation source, said means comprising lengthwise extending notched braces on the nether surface of said elongate planar sheet, so that the notched braces provide reinforcing to said elongate planar sheet and releasably lock the elongate planar sheet to the patient table.

2. The apparatus of claim 1 wherein said head portion supports a releasably detachable head pillow having a central opening therein for the face of a patient.

3. The apparatus of claim 2 wherein said head pillow is releasably attached by a fastener and comprises a U-shaped pillow.

4. The apparatus of claim 3 wherein said fastener is a hook and loop type fastener.

5. The apparatus of claim 3 including a releasably attached cushion supporting a portion of the body of the patient below the head of the patient and having sufficient width under the patient to provide comfort thereto.

6. The apparatus of claim 1 including left and right marginal edges having downwardly extending table clamps to releasably secure along the edges of a supporting table.

7. The apparatus of claim 1 wherein said apparatus has a length greater than the width and said head portion is at the end of the length thereof.

8. The apparatus of claim 1 wherein said elongate planar sheet is about ½" in thickness, and said head portion is about 9 to about 12" in width and said head portion is supported on the nether side thereof by a pair of lengthwise braces symmetrically deployed to support patient weight thereon.

9. An extension apparatus for attachment to a table supporting a patient which apparatus comprises a planar elongate sheet member of sufficient thickness to have adequate strength and wherein said member has a centerline and is symmetrically deployed left and right thereof, and has a main portion adapted to support the body of a patient thereon and has a symmetrically aligned end located head portion for support of the head of the patient thereon said sheet member further incorporates at least two clamps thereon spaced so that said sheet member is releasably attachable to a support table said member including lengthwise extending notched braces on the nether side thereof, so that said notched braces provide reinforcing to said member and releasably lock the member to a table.

10. The apparatus of claim 9 wherein said head portion supports a releasably detachable head pillow having a central aligned opening therein for the face of a patient.

11. The apparatus of claim 10 wherein said head pillow is releasably attached by a fastener and comprises a U-shaped pillow.

12. The apparatus of claim 11 wherein said fastener is a hook and loop type fastener.

13. The apparatus of claim 12 including a releasably attached cushion supporting a portion of the body of the patient below the head the patient and having sufficient width under the patient to provide comfort thereto.

* * * * *